US007311345B2

(12) United States Patent
Kerr

(10) Patent No.: US 7,311,345 B2
(45) Date of Patent: Dec. 25, 2007

(54) GOLF BALL RETRIEVER

(75) Inventor: Gerry Kerr, South Surrey (CA)

(73) Assignee: Gerry H. Kerr, South Surrey, B.C. (CA)

( * ) Notice: Subject to any disclaimer, the term of this patent is extended or adjusted under 35 U.S.C. 154(b) by 0 days.

(21) Appl. No.: 11/296,413

(22) Filed: Dec. 8, 2005

(65) Prior Publication Data

US 2006/0091682 A1 May 4, 2006

Related U.S. Application Data

(63) Continuation-in-part of application No. 10/914,236, filed on Aug. 10, 2004, now abandoned.

(60) Provisional application No. 60/544,179, filed on Feb. 11, 2004.

(51) Int. Cl.
*A63B 47/02* (2006.01)

(52) U.S. Cl. ..... 294/19.2

(58) Field of Classification Search ..... 294/19.2, 294/19.1; 56/400.11, 400.16, 400.18, 400.21; 473/286

See application file for complete search history.

(56) References Cited

U.S. PATENT DOCUMENTS

| | | | | |
|---|---|---|---|---|
| 1,658,145 A | | 2/1928 | Uyei | |
| 2,538,325 A | * | 1/1951 | Pfeiffer | 294/19.2 |
| 2,738,214 A | | 3/1956 | Zimmers | |
| 3,442,544 A | | 5/1969 | Faber | |
| 3,669,427 A | | 6/1972 | Curtis | |
| 4,313,632 A | | 2/1982 | King et al. | |
| 4,728,134 A | | 3/1988 | Allen | |
| 4,844,526 A | | 7/1989 | Young | |
| 5,246,260 A | | 9/1993 | Racicot | |
| 5,303,967 A | | 4/1994 | Dubow | |
| 5,423,584 A | | 6/1995 | Pasternak | |
| 5,460,366 A | | 10/1995 | Pugh | |
| 5,651,571 A | | 7/1997 | Diveto | |
| 5,662,366 A | | 9/1997 | Fraske | |
| 5,829,806 A | | 11/1998 | Sykes | |
| 5,899,511 A | * | 5/1999 | Dinatale | 294/19.2 |
| 5,997,062 A | | 12/1999 | Schwartz | |

(Continued)

FOREIGN PATENT DOCUMENTS

GB 2 128 484 A 5/1984

(Continued)

*Primary Examiner*—Patrick Mackey
*Assistant Examiner*—Paul T Chin

(57) ABSTRACT

The golf ball retriever is a retrieval device for recovering golf balls from water hazards or the like. The golf ball retriever has a handle connected to a ball receiving body. The ball receiving body has a pair of posterior fingers, several anterior fingers and a cavity. The cavity holds the golf ball once a user has drawn or forced the ball into the cavity. The user forces the golf ball into the cavity by pressing the golf ball retriever down upon the golf ball, allowing the flexible anterior fingers to flex outward then enclose about the golf ball. Additionally, the user may position the golf ball retriever in front of the golf ball and pull backwards over the ball. The posterior fingers guide the golf ball into the cavity where the ball becomes trapped. Further, the inner surface of the retriever has at least one protuberance to assist the golf ball into the cavity and to retain the ball in the cavity.

12 Claims, 6 Drawing Sheets

U.S. PATENT DOCUMENTS

| | | | | |
|---|---|---|---|---|
| 6,059,334 | A | 5/2000 | LaCourse et al. | |
| 6,257,635 | B1 | 7/2001 | Torelli | |
| 6,514,159 | B2 * | 2/2003 | Hendren | 473/408 |
| 6,695,370 | B2 | 2/2004 | Johnson | |
| 2003/0195054 | A1 | 10/2003 | Rioux | |

FOREIGN PATENT DOCUMENTS

| | | | |
|---|---|---|---|
| GB | 2 282 973 | A | 4/1995 |
| GB | 2 305 865 | A | 4/1997 |

* cited by examiner

GOLF BALL RETRIEVER

CROSS-REFERENCE TO RELATED APPLICATION

This application claims the benefit of U.S. Provisional Patent Application Ser. No. 60/544,179, filed Feb. 11, 2004, and is a C-I-P of patent application Ser. No. 10/914,236, filed Aug. 10, 2004, now abandoned on Jun. 23, 2006.

BACKGROUND OF THE INVENTION

1. Field of the Invention

The present invention relates to retrieving devices, and particularly to a golf ball retriever.

2. Description of the Related Art

Golf is a sport of immense popularity, attracting all manner of players, from the very skilled to the inexpert. With the various levels of proficiency comes a substantial problem—many golf balls being lost due to errant hits. A number of balls are hit into bushes, where a golfer could theoretically retrieve them if found. However, a number of balls are also hit into water hazards, and even if a golfer sees where the golf ball has landed, he is likely loath to retrieve the ball. As golf balls can cost upward of three dollars a piece, abandoning the balls may prove to be rather costly to the golfer.

Thus, golf ball retrievers for recovering golf balls from water hazards are quite helpful to golfers and reduce the expense associated with the game. Various retrievers have been developed that use numerous methods of recovering the balls. Some devices are cuplike in shape and scoop up the golf ball. Other devices use fingers or claws to rake the ball up from the water hazard. Some devices allow the user to attach the retriever to the golfer's golf club. However, these retrievers do not necessarily provide the most effective means for retrieving a golf ball. They may not provide multiple methods of retrieving the golf ball. They may not provide a guide to pull the golf ball into the fingers such that the fingers easily surround the ball. They may not provide enough claws to trap the golf ball the most effectively.

Accordingly, there is a need for a golf ball retriever that can guide the golf ball into the retriever to be trapped and trap the ball by pressing straight down on the golf ball.

U.S. Pat. No. 2,738,214, issued Mar. 13, 1956 to M. Zimmers, shows a golf ball retriever having claw-shaped fingers. The claw-shaped fingers may either be used as a scoop or as a rake, based on the preference of the user. When used as a rake, the golf ball sets between the fingers, and the fingers hold the golf ball for retrieval.

U.S. Pat. No. 4,313,632, issued Feb. 2, 1982 to G. King (deceased) et al., shows a golf ball retriever for recovering golf balls from water hazards. The retriever has four fingers used to retrieve the balls. Two of the fingers allow a user to scoop up a golf ball. The other two fingers allow a user to grip a golf ball to recover it from the water hazard.

U.S. Pat. No. 5,460,366, issued Oct. 24, 1995 to A. Pugh, shows a golf ball retriever that recovers golf balls. The retriever is configured to attach to the butt of a golf club. As the retriever is pressed down on a golf ball, the claws of the retriever grip the ball, allowing retrieval of the golf ball.

Other patents showing golf ball retrievers include U.S. patent Pub. No. 2003/0195054 A1, published Oct. 16, 2003 and invented by C. Rioux (retractible golf ball retriever); U.S. Pat. No. 1,658,145, issued Feb. 7, 1928 to N. Uyei (device for picking up golf balls for golf players); U.S. Pat. No. 3,442,544, issued May 6, 1969 to S. Faber (golf ball retriever); U.S. Pat. No. 3,669,427, issued Jun. 13, 1972 to G. Curtis (golf ball retriever); U.S. Pat. No. 4,728,134, issued Mar. 1, 1988 to F. Allen (golf ball retriever); U.S. Pat. No. 4,844,526, issued Jul. 4, 1989 to F. Young (golf ball retriever).

Additional patents showing golf ball retrievers include U.S. Pat. No. 5,246,260, issued Sep. 21, 1993 to C. Racicot (retriever for golf balls in water hazards); U.S. Pat. No. 5,303,967, issued Apr. 19, 1994 to I. Dubow (golf ball retrieving device); U.S. Pat. No. 5,423,584, issued Jun. 13, 1995 to M. Pasternak (golf ball retriever); U.S. Pat. No. 5,651,571, issued Jul. 29, 1997 to A. Diveto (golf ball retriever); U.S. Pat. No. 5,662,366, issued Sep. 2, 1997 to A. Fraske (golf ball retriever); U.S. Pat. No. 5,829,806, issued Nov. 3, 1998 to W. Sykes (golf ball retriever); U.S. Pat. No. 5,997,062, issued Dec. 7, 1999 to N. Schwartz (golf ball retriever); U.S. Pat. No. 6,059,334, issued May 9, 2000 to M. LaCourse et al. (golf ball retriever and method); U.S. Pat. No. 6,257,635 B1, issued Jul. 10, 2001 to V. Torelli (golf ball retriever); U.S. Pat. No. 6,695,370 B2, issued Feb. 24, 2004 to T. Johnson (golf ball retrieval device and method).

Further patents showing golf ball retrievers include UK Pat. No. GB 2 128 484 A, published May 2, 1984 (a golf club grip having a golf ball retriever portion); UK Pat. No. GB 2 282 973 A, published Apr. 26, 1995 (golf ball retrieval device); UK Pat. No. GB 2 305 865 A, published Apr. 23, 1997 (golf ball retrieving device).

None of the above inventions and patents, taken either singly or in combination, is seen to describe the instant invention as claimed. Thus a golf ball retriever solving the aforementioned problems is desired.

SUMMARY OF THE INVENTION

The golf ball retriever is a retrieval device for recovering golf balls from water hazards or the like. The golf ball retriever has a handle connected to a ball receiving body, which receives golf balls. The retriever attaches to a shaft by the handle or is integrally connected to the shaft. The ball receiving body has a pair of posterior fingers, several anterior fingers and a cavity. The posterior fingers angle outwardly and define a posterior opening dimensioned slightly larger than the diameter of the golf ball. The anterior fingers are flexible and angle inwardly. The anterior fingers define the cavity into which the ball locks. The end tips of the anterior fingers define a cavity opening dimensioned slightly smaller than the diameter of the golf ball.

The cavity holds the golf ball once the ball has been drawn or forced into the cavity. A user forces the golf ball into the cavity by pressing the golf ball retriever down upon the golf ball. The pressure exerted on the golf ball causes the flexible tips of the anterior fingers to flex outward then enclose about the golf ball, thereby trapping the ball within the cavity. Additionally, the user may position the golf ball retriever in front of the golf ball and pull backwards over the ball. The posterior fingers guide the golf ball into the cavity where the ball becomes trapped. Further, the posterior opening has a configured surface permitting easy movement of the golf ball into the cavity opening for retention by the anterior fingers. Additionally, the anterior end of the configured surface is provided with at least one configured protuberance that assists the golf ball into the cavity opening and/or provides a stop once the golf ball is retained in the cavity opening.

The ball receiving body has elongated apertures extended along the top perimeter of the ball receiving body. The elongated apertures allow water and mud to pass through the ball receiving body when dredging for golf balls in water hazards.

One aspect of the invention is that the ball may be trapped in one of two ways. A user may press down directly on the golf ball and capture the ball in the cavity with the retriever fingers. A user may pull the golf ball retriever backwards over the ball and guide the ball into the cavity. Additionally, the inner surface of the retriever may be provided with at least one protuberance that assists the guidance of the golf ball into the cavity and/or acts as a stop or limit once the ball is located within the cavity.

Another aspect of the invention is that the golf ball retriever traps a golf ball so that it may be lifted out of the water hazard. A further aspect of the invention is that the golf ball retriever may dredge through water and mud to retrieve the ball without capturing a large amount of mud and water within the retriever body.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1A:
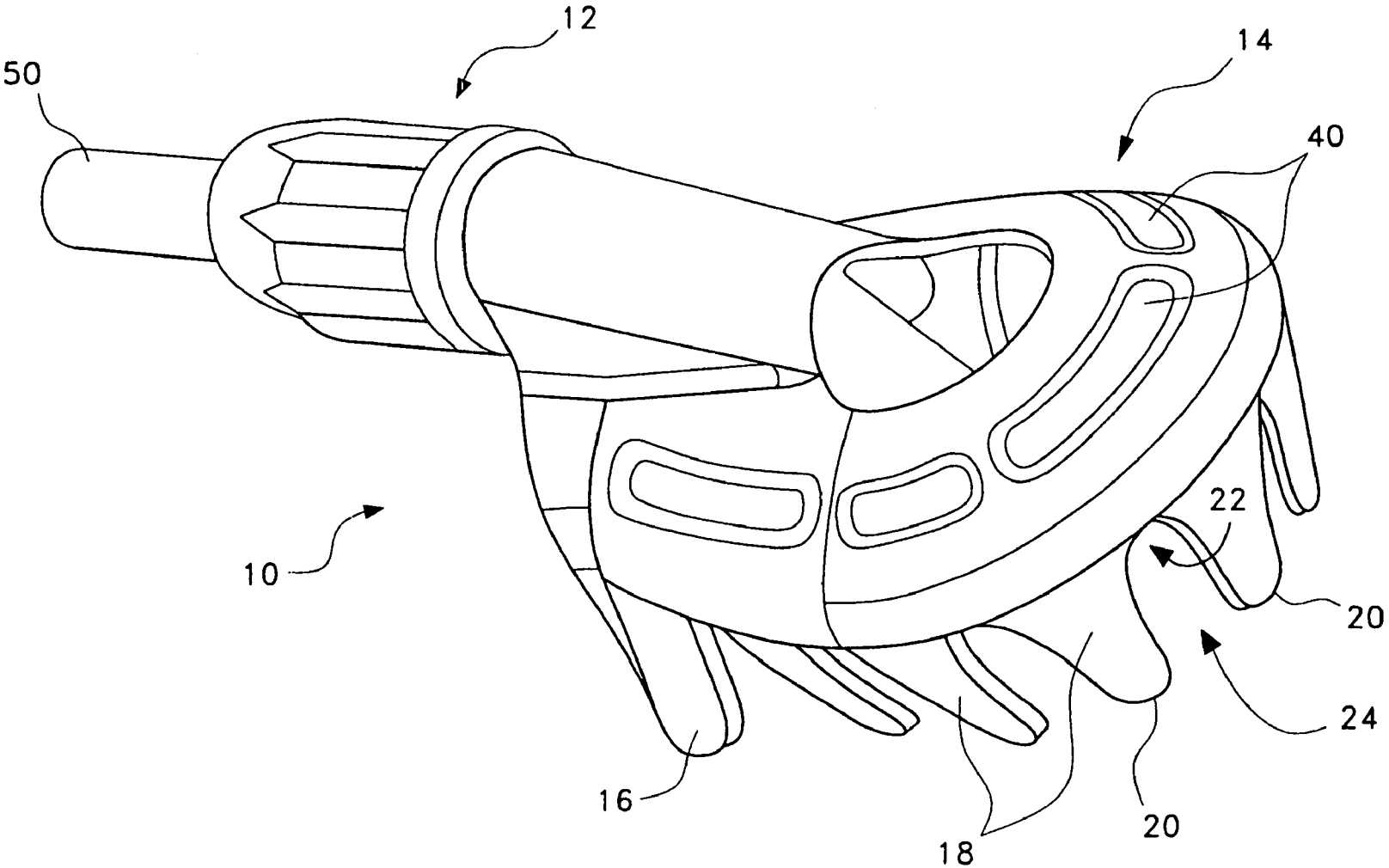
FIG. 1A is a front perspective view of a golf ball retriever according to the present invention.

The present invention is a golf ball retriever, designated generally as 10 in the drawings. The golf ball retriever 10 has a handle 12 and a ball receiving body 14. The ball receiving body 14 includes a pair of posterior fingers 16 and multiple anterior fingers 18. The handle 12 is attached to a shaft 50.

Referring first to FIG. 1A, the front of the golf ball retriever 10 is shown. The handle 12 is integrally connected to the ball receiving body 14. The handle 12 is attached to the shaft 50 by fitting the shaft 50 onto the handle 12. The ball receiving body 14 has posterior fingers 16 extending down and angled outwardly to allow a golf ball 30 to pass between the posterior fingers 16. The ball receiving body 14 has anterior fingers 18 extending down and angled inwardly. The anterior fingers 18 define a cavity 22 into which a golf ball 30 locks. End tips 20 of the anterior fingers 18 define a cavity opening 24 dimensioned slightly smaller than the diameter of the golf ball 30. The anterior fingers 18 are flexible. The entire ball receiving body 14 may be flexible.

The ball receiving body 14 has elongated apertures 40 extended along the top perimeter of the ball receiving body 14. The elongated apertures 40 allow water and mud to pass through the ball receiving body 14 when dredging for golf balls in water hazards.

Figure 1B:
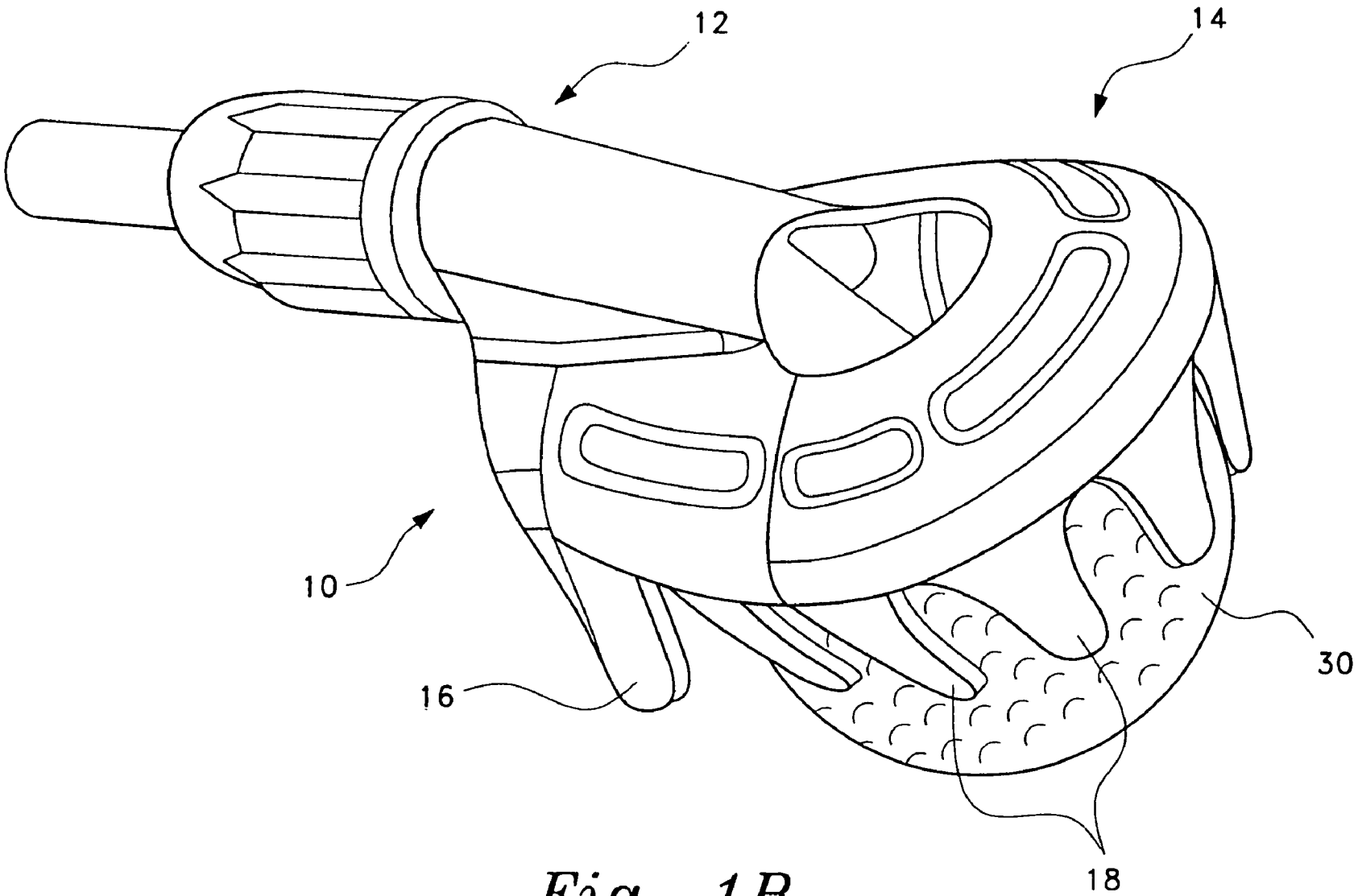
FIG. 1B is a front perspective view of the golf ball retriever according to the present invention holding a golf ball.

FIG. 1B shows the golf ball retriever 10 having a golf ball 30 situated within the cavity 22 of the retriever 10. The cavity will hold the golf ball 30 once the ball 30 has been drawn into the cavity 22 or forced through the cavity opening 24 into the cavity 22. A user forces the golf ball 30 into the cavity 22 by pressing the golf ball retriever 10 down upon the golf ball 30. The pressure exerted on the golf ball 30 causes the anterior fingers 18 to flex outward then enclose about the golf ball 30, thereby trapping the ball 30 within the cavity 22. Additionally, the user may position the golf ball retriever 10 in front of the golf ball 30 and pull backwards over the ball 30. The pair of posterior fingers 16 guides the golf ball 30 into the cavity 22 where the ball 30 becomes trapped.

Figure 2:
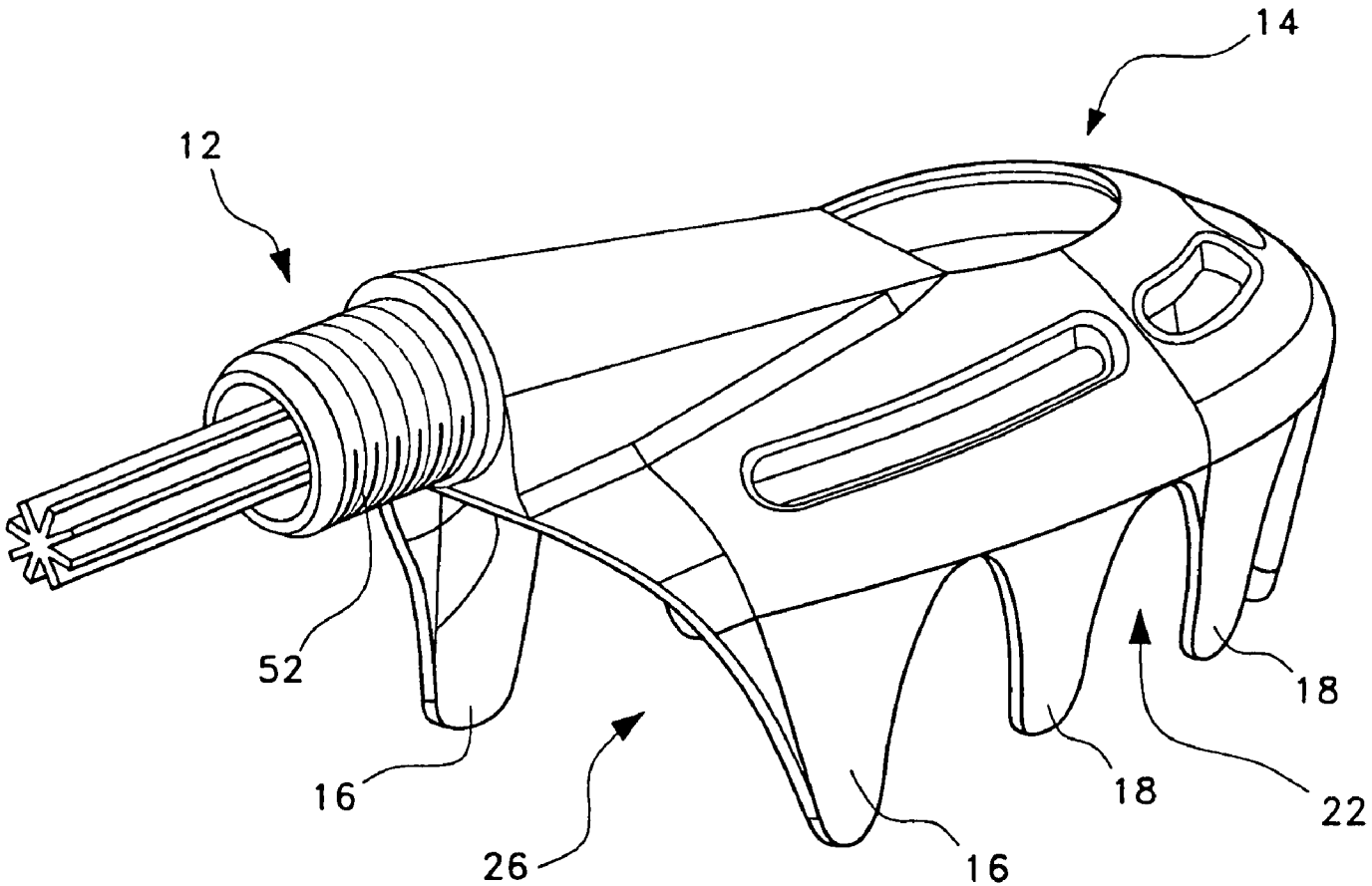
FIG. 2 is a rear perspective view of the golf ball retriever according to the present invention.

FIG. 2 shows a rear perspective view of the golf ball retriever 10. The handle 12 is shown unattached to the shaft 50. The handle 12 includes a thread 52, which allows the shaft 50 to attach to the handle 12 by rotating the shaft 50 onto the thread 52 of the handle 12. The posterior fingers 16 define a posterior opening 26 dimensioned slightly larger than the diameter of the golf ball 30. When rolled backwards over the golf ball 30, the posterior fingers 16 guide the ball 30 into the cavity 22 such that the anterior fingers 18 substantially surround the golf ball 30.

Figure 3:
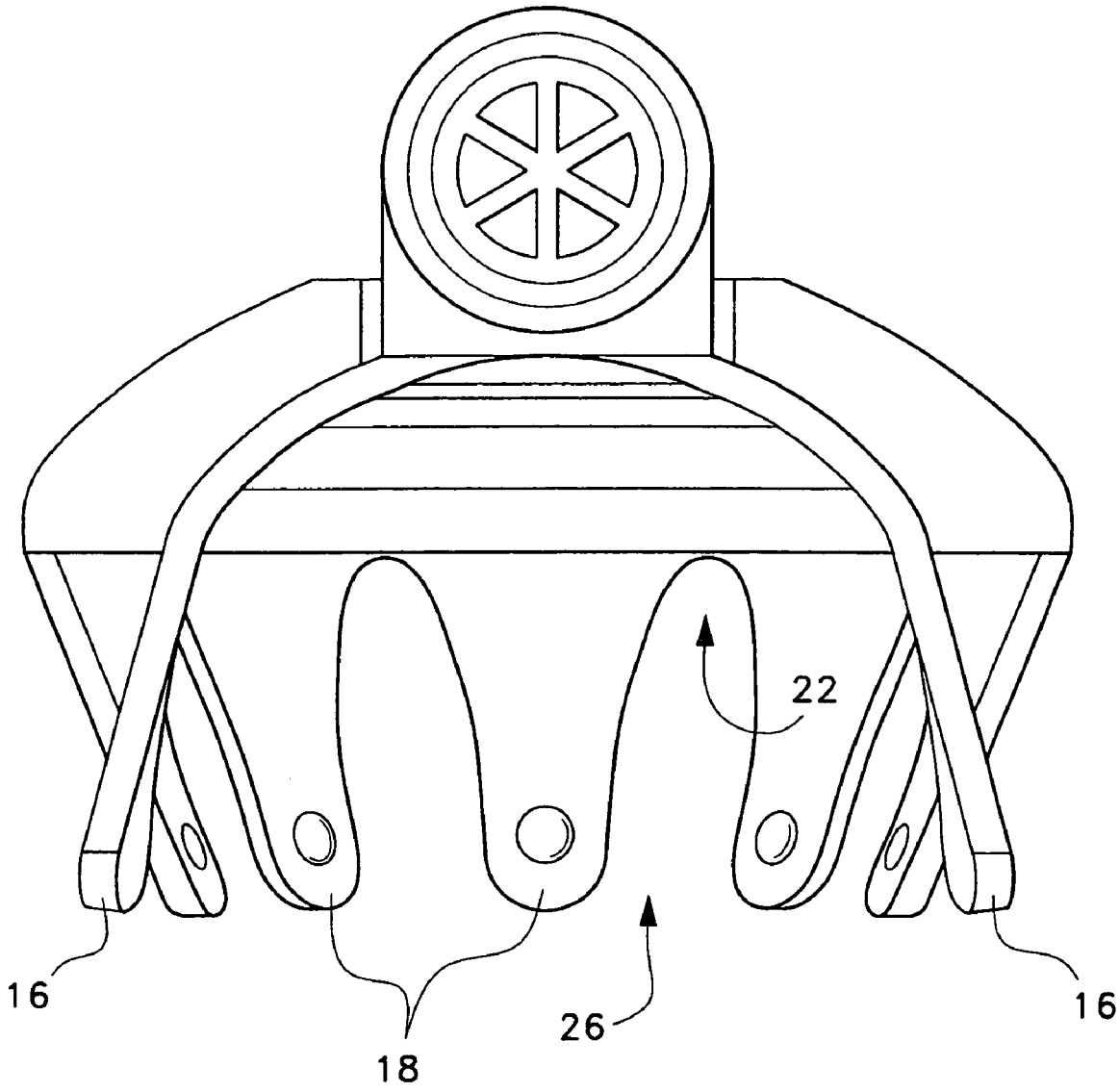
FIG. 3 is an elevational rear view of the golf ball retriever according to the present invention.

A rear view of the golf ball retriever 10 is shown in FIG. 3. The posterior fingers 16 are angled outwardly. The posterior opening 26 allows the golf ball 30 to enter the ball receiving body 14 and become trapped within the cavity 22. The anterior fingers 18 are angled inwardly.

Figure 4:
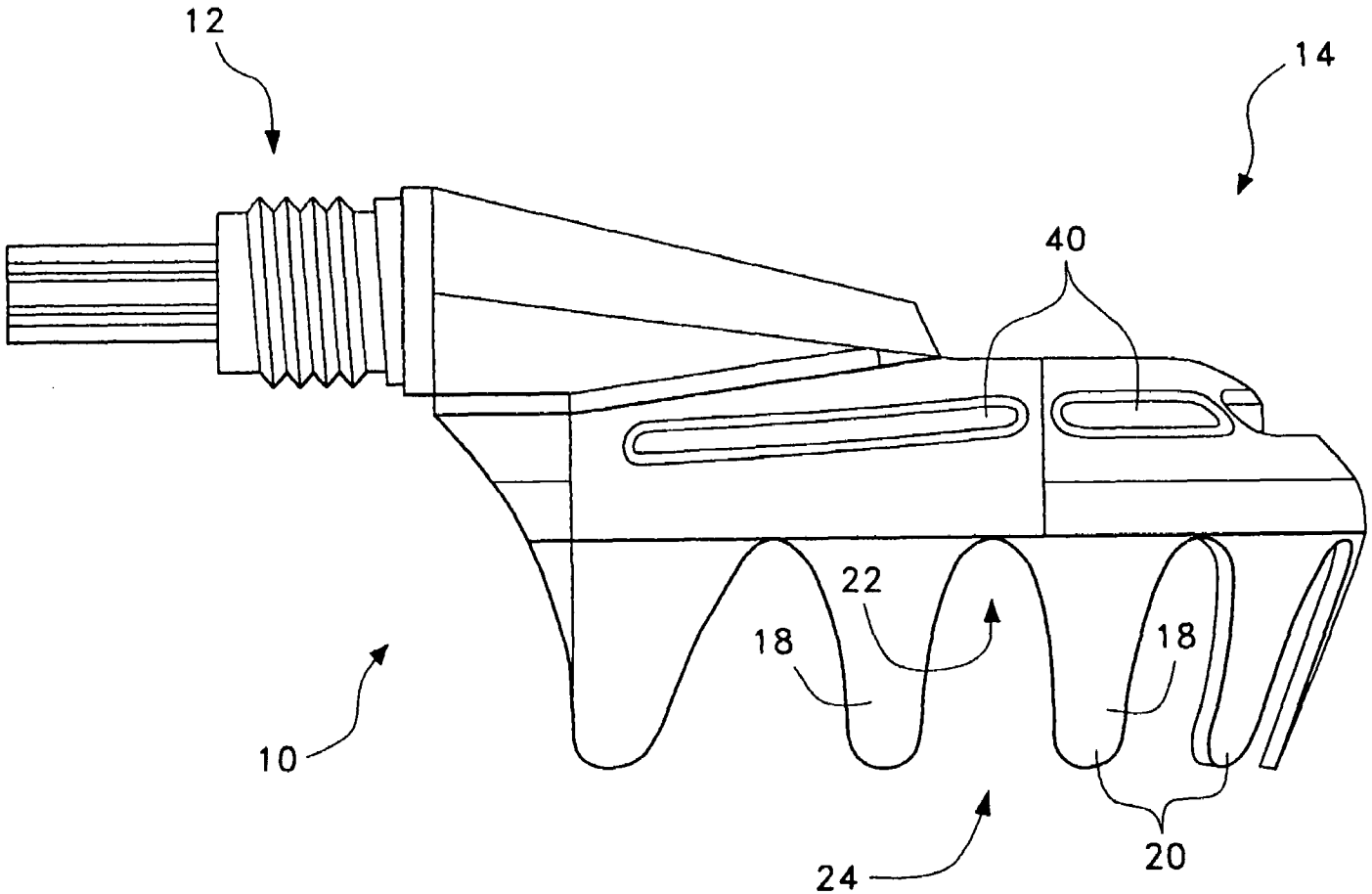
FIG. 4 is an elevational side view of the golf ball retriever according to the present invention.

FIG. 4 shows the golf ball retriever 10 in a side view. The end tips 20 of the anterior fingers 18 are shown angled inward. The elongated apertures 40 extend about the top perimeter of the ball receiving body 14.

The thread 52 may be omitted and the handle 12 may attach to a shaft 50 by crimping the shaft 50 onto the handle 12 or by using a set screw to attach the shaft 50 to the handle 12. The shaft 50 may additionally be integrally connected to the handle 12 such that the shaft 50 and handle 12 are permanently united.

Figure 5:
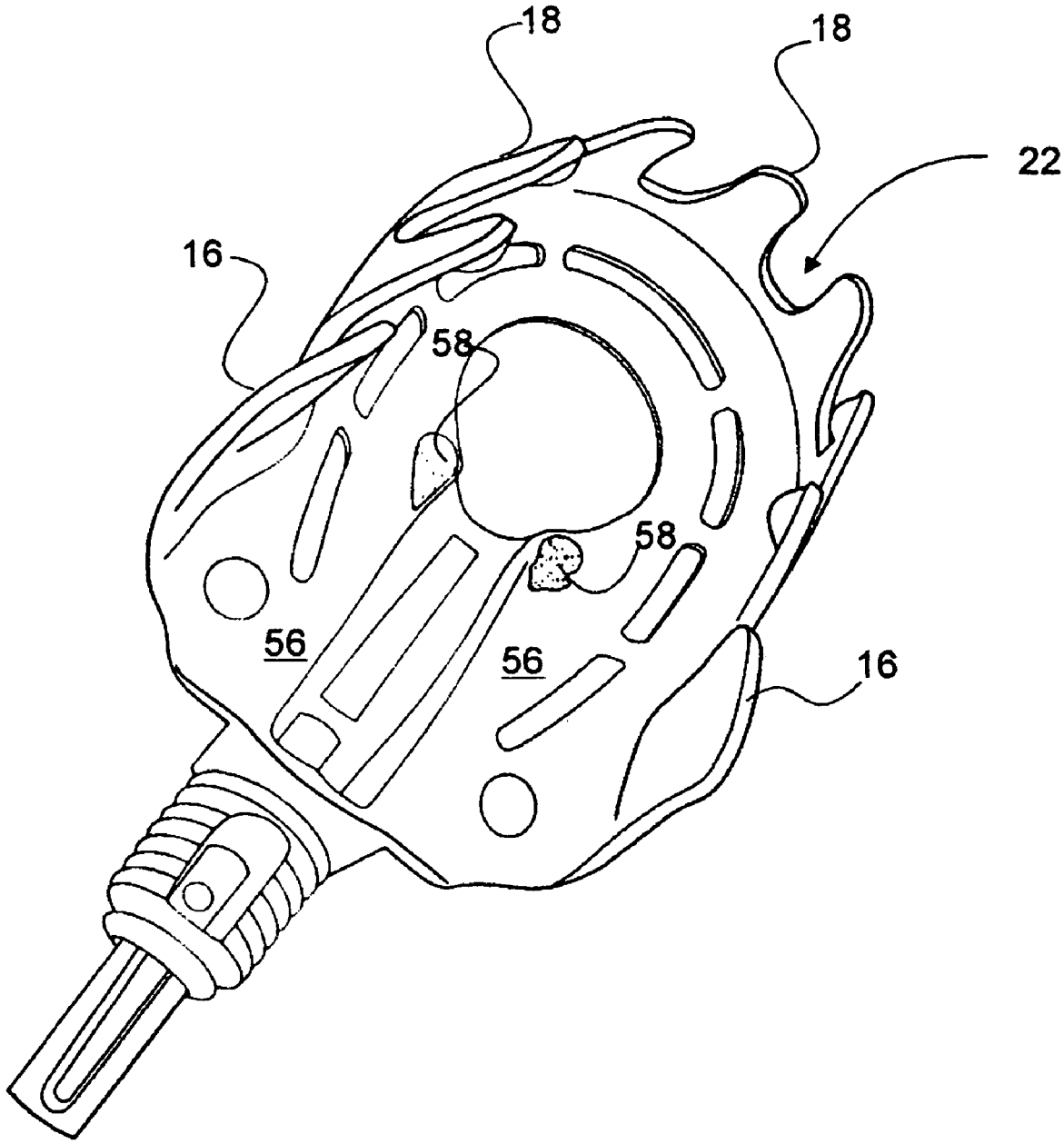
FIG. 5 is a perspective view of the underside of the golf ball retriever according to the present invention.

The underside of the golf ball retriever 10 is illustrated in FIG. 5. The posterior opening 26 is slightly larger than the diameter of the golf ball 30. Surface 56 is configured to guide the ball into cavity 22 as previously discussed. Additionally, at least one configured protuberance 58 is provided adjacent surface 56. Surface 56 leading from the posterior opening 54 may be configured in any way to assist the golf ball movement towards cavity 22. For example, the surface may be sloped towards cavity 22. The protuberance(s) may be configured and connected to the surface in any way to assist the golf ball movement into cavity 22 and to stop or limit the golf ball movement once the ball is retained in the cavity by the end tips 20 of the anterior fingers 18. For example, the protuberances are rounded knobs integrally formed with the retriever body 14.

It is to be understood that the present invention is not limited to the embodiments described above, but encompasses any and all embodiments within the scope of the following claims.

I claim:

1. A golf ball retriever for recovering a golf ball, comprising:

a handle;

a ball receiving body, said ball receiving body having an outer surface and an inner surface;

a pair of spaced apart posterior fingers extending downwardly from the ball receiving body;

a plurality of anterior fingers extending downwardly from the ball receiving body, each finger having an end tip;

wherein the handle is connected to the ball receiving body;

wherein the pair of posterior fingers defines a posterior opening slightly larger than a diameter of the golf ball whereby the ball may move freely therethrough;

wherein the plurality of anterior fingers defines a cavity bounded by said inner surface;

wherein the end tips of the anterior fingers define a cavity opening slightly smaller than the posterior opening formed by the pair of posterior fingers and slightly smaller than the diameter of the golf ball; and at least one protuberance fixedly disposed on said inner surface within the cavity defined by the anterior fingers, whereby said at least one protuberance assists the end tips of the anterior fingers in retaining the golf ball within said cavity by limiting movement of the ball towards the posterior opening.

2. The golf ball retriever according to claim 1, wherein the handle is attached to a shaft.

3. The golf ball retriever according to claim 2, wherein the handle has a thread for telescoping the handle onto the shaft.

4. The golf ball retriever according to claim 1, wherein the plurality of anterior fingers is flexible.

5. The golf ball retriever according to claim 1, wherein the ball receiving body is fabricated of a flexible material.

6. The golf ball retriever according to claim 1, wherein the ball receiving body has a plurality of spaced apart elongated apertures extending along the outer surface of the ball receiving body.

7. The golf ball retriever according to claim 1, wherein the plurality of anterior fingers are angled inwardly.

8. A golf ball retriever for recovering a golf ball, comprising:

a shaft;

a handle integrally connected to the shaft;

a ball receiving body, said ball receiving body having an outer surface and an inner surface;

a pair of spaced apart posterior fingers extending downwardly from the ball receiving body;

at least three flexible anterior fingers extending downwardly from the ball receiving body, each finger having a respective distal end tip;

wherein the pair of posterior fingers and the at least three anterior fingers are integrally connected to the ball receiving body;

wherein the pair of posterior fingers defines a posterior opening slightly larger than a diameter of the golf ball whereby the ball may move freely therethrough along the inner surface of the body;

wherein the at least three anterior fingers defines a cavity; and wherein the distal end tips of the anterior fingers define a cavity opening slightly smaller than the posterior opening formed by the pair of posterior fingers and slightly smaller than the diameter of the golf ball, whereby a ball may be retained within the cavity by the anterior fingers.

9. The golf ball retriever according to claim 8, wherein the ball receiving body is fabricated of a flexible material.

10. The golf ball retriever according to claim 9, wherein the at least three anterior fingers are angled inwardly.

11. The golf ball retriever according to claim 9, wherein the pair of posterior fingers are angled outwardly.

12. The golf ball retriever according to claim 8, wherein the ball receiving body has a plurality of spaced apart elongated apertures extending along the outer surface of the ball receiving body.

* * * * *